US011648745B2

(12) United States Patent
Peck

(10) Patent No.: US 11,648,745 B2
(45) Date of Patent: May 16, 2023

(54) MODULAR TOOLING FOR AXLE HOUSING AND MANUFACTURING PROCESS

(71) Applicant: Mahindra N.A. Tech Center, Auburn Hills, MI (US)

(72) Inventor: David E. Peck, Rochester Hills, MI (US)

(73) Assignee: Mahindra N.A. Tech Center, Auburn Hills, MI (US)

( * ) Notice: Subject to any disclaimer, the term of this patent is extended or adjusted under 35 U.S.C. 154(b) by 275 days.

(21) Appl. No.: 17/015,272

(22) Filed: Sep. 9, 2020

(65) Prior Publication Data

US 2022/0072600 A1 Mar. 10, 2022

(51) Int. Cl.

| | |
|---|---|
| ***B26D 1/01*** | (2006.01) |
| ***B30B 1/40*** | (2006.01) |
| ***B26D 5/16*** | (2006.01) |
| *B21D 37/08* | (2006.01) |
| *B21D 22/02* | (2006.01) |
| *B26D 1/00* | (2006.01) |
| *B26D 7/00* | (2006.01) |

(52) U.S. Cl.

CPC ..... *B30B 1/40* (2013.01); *B26D 1/01* (2013.01); *B26D 5/16* (2013.01); *B21D 22/02* (2013.01); *B21D 37/08* (2013.01); *B26D 2001/0053* (2013.01); *B26D 2007/0068* (2013.01)

(58) Field of Classification Search

CPC .... B30B 1/40; B26D 1/01; B26D 5/16; B26D 2001/0053; B26D 2007/0068; B21D 22/02; B21D 37/08

See application file for complete search history.

(56) References Cited

U.S. PATENT DOCUMENTS

| | | | |
|---|---|---|---|
| 2,204,287 | A | 6/1940 | Wilber |
| 2,478,180 | A | 8/1949 | Buckendale |

(Continued)

FOREIGN PATENT DOCUMENTS

| | | | |
|---|---|---|---|
| DE | 20221813 | U1 | 2/2008 |
| JP | 10009258 | A | 1/1998 |

(Continued)

OTHER PUBLICATIONS

U.S. Appl. No. 17/015,294, filed Sep. 9, 2020, David Peck.

(Continued)

*Primary Examiner* — Evan H Macfarlane
*Assistant Examiner* — Liang Dong
(74) *Attorney, Agent, or Firm* — Harness, Dickey & Pierce, P.L.C.

(57) ABSTRACT

A modular tooling die for an axle housing includes a plurality of separable and coaxially aligned die sets. Each die set may include a cam driver that is engageable with first and second cam slide assemblies. The cam slide assemblies move toward one another along an axis that extends perpendicularly to an axis along which the cam driver translates. Multiple die sets are provided for possible use in a single press depending on the particular axle housing geometry to be manufactured. A wide variety of different geometrical configurations may be formed by simply replacing one or more die sets and inserting a differently sized or shaped blank within the press. A method of manufacturing various axle housings and the associated modular tooling is described.

8 Claims, 11 Drawing Sheets

(56) References Cited

U.S. PATENT DOCUMENTS

| | | | | |
|---|---|---|---|---|
| 2,674,783 | A | 4/1954 | Schneider et al. | |
| 2,961,888 | A | 11/1960 | Wildharber | |
| 3,706,350 | A | 12/1972 | Bokovoy | |
| 3,838,751 | A | 10/1974 | Brown | |
| 4,610,185 | A * | 9/1986 | France | B23D 65/02 83/685 |
| 4,660,401 | A * | 4/1987 | Kohama | F16C 33/14 72/402 |
| 4,921,036 | A | 5/1990 | Kuwahara | |
| 5,267,489 | A | 12/1993 | Ziech | |
| 5,271,294 | A | 12/1993 | Osenbaugh | |
| 5,411,699 | A | 5/1995 | Collette et al. | |
| 5,492,419 | A | 2/1996 | Miller et al. | |
| 5,634,374 | A | 6/1997 | Depietri | |
| 5,775,975 | A | 7/1998 | Mizuno et al. | |
| 5,840,350 | A | 11/1998 | Salemi | |
| 5,884,980 | A | 3/1999 | Visser et al. | |
| 6,058,605 | A * | 5/2000 | Binder | B23D 21/14 83/54 |
| 6,093,127 | A | 7/2000 | DiDomenico et al. | |
| 6,349,781 | B1 | 2/2002 | Kruse | |
| 6,364,803 | B1 | 4/2002 | Barnholt et al. | |
| 6,514,169 | B2 | 2/2003 | Turner et al. | |
| 6,561,788 | B1 | 5/2003 | Gaudoin | |
| 6,609,649 | B1 | 8/2003 | Barnholt et al. | |
| 6,623,867 | B2 | 9/2003 | Crocco et al. | |
| 6,729,206 | B2 | 5/2004 | Hayabuchi et al. | |
| 6,863,634 | B2 | 3/2005 | Holman et al. | |
| 6,896,270 | B1 | 5/2005 | Sturman et al. | |
| 6,948,924 | B2 | 9/2005 | Tsau et al. | |
| 6,979,131 | B1 | 12/2005 | Lippert et al. | |
| 7,004,277 | B2 | 2/2006 | Pollock et al. | |
| 7,137,183 | B2 | 11/2006 | Stuart et al. | |
| 7,210,374 | B2 | 5/2007 | Leimann | |
| 7,231,847 | B2 | 6/2007 | Hibbler et al. | |
| 7,258,644 | B2 | 8/2007 | Ziech et al. | |
| 7,287,911 | B2 | 10/2007 | Dodoro et al. | |
| 7,306,536 | B2 | 12/2007 | Ziech | |
| 7,377,598 | B2 | 5/2008 | Doud et al. | |
| 7,503,240 | B2 | 3/2009 | Hibbler et al. | |
| 7,537,390 | B2 | 5/2009 | De Boer et al. | |
| 7,585,032 | B2 | 9/2009 | Seeds et al. | |
| 7,658,128 | B2 | 2/2010 | Sugano | |
| 7,984,552 | B2 | 7/2011 | Doud et al. | |
| 8,166,848 | B2 | 5/2012 | Uozumi et al. | |
| 8,176,811 | B2 | 5/2012 | Peterson et al. | |
| 8,186,884 | B2 | 5/2012 | Henneberger | |
| 8,464,611 | B1 | 6/2013 | Chandler | |
| 8,469,462 | B2 | 6/2013 | Doud et al. | |
| 8,573,087 | B2 | 11/2013 | Stadtfeld | |
| 8,591,116 | B2 | 11/2013 | Fedorovich | |
| 8,776,374 | B2 | 7/2014 | Johnston et al. | |
| 8,881,401 | B2 | 11/2014 | Aoyama et al. | |
| 8,911,312 | B2 | 12/2014 | Itoo et al. | |
| 8,951,034 | B2 | 2/2015 | Christiansen et al. | |
| 9,022,893 | B2 | 5/2015 | Hirao et al. | |
| 9,151,329 | B2 | 10/2015 | Katsaros | |
| 9,221,219 | B2 | 12/2015 | Frederiksen | |
| 9,517,658 | B2 | 12/2016 | Chung et al. | |
| 9,669,710 | B2 | 6/2017 | Meixner | |
| 9,746,069 | B2 | 8/2017 | Gerstenberger et al. | |
| 9,810,309 | B2 | 11/2017 | Chen et al. | |
| 9,884,359 | B2 | 2/2018 | Peters et al. | |
| 10,179,478 | B2 | 1/2019 | Bauer et al. | |
| 10,352,431 | B2 | 7/2019 | Nakagawa et al. | |
| 2003/0070501 | A1 | 4/2003 | Bell | |
| 2005/0238273 | A1 | 10/2005 | Kawamura et al. | |
| 2012/0021863 | A1 | 1/2012 | Hirao et al. | |
| 2015/0020626 | A1 | 1/2015 | Aoyama et al. | |
| 2015/0087461 | A1 | 3/2015 | Jackson et al. | |
| 2015/0211604 | A1 | 7/2015 | Hirao et al. | |
| 2018/0259038 | A1 | 9/2018 | Aoyama et al. | |
| 2019/0024772 | A1 | 1/2019 | Ketchel et al. | |
| 2019/0293168 | A1 | 9/2019 | Abe et al. | |

FOREIGN PATENT DOCUMENTS

| | | | |
|---|---|---|---|
| JP | H 109259 | A | 1/1998 |
| KR | 20140069451 | A | 6/2014 |
| KR | 10-1982224 | B1 | 5/2019 |
| WO | WO-9626844 | A1 | 9/1996 |
| WO | WO-2017/216404 | A1 | 12/2017 |

OTHER PUBLICATIONS

U.S. Appl. No. 17/015,430, filed Sep. 9, 2020, David Peck.
U.S. Appl. No. 17/015,472, filed Sep. 9, 2020, David Peck.
U.S. Appl. No. 17/015,543, filed Sep. 9, 2020, David Peck.

* cited by examiner

MODULAR TOOLING FOR AXLE HOUSING AND MANUFACTURING PROCESS

FIELD

The disclosure relates to axle assemblies for vehicles, such as front or rear drive axle assemblies used in automobiles and trucks.

BACKGROUND

This section provides background information related to the present disclosure which is not necessarily prior art.

Axle assemblies are commonly used to support and/or rotationally drive the wheels of a vehicle. For example, a vehicle may include a front axle assembly to which front wheels of the vehicle are mounted and a rear axle assembly to which rear wheels of the vehicle are mounted. Typically, the front and rear axle assemblies extend across the vehicle in a transverse direction that is perpendicular to the direction of vehicle travel. The front and rear axle assemblies support the front and rear wheels and are connected to a body and/or frame of the vehicle by front and rear suspension systems that articulate to allow the front and rear axle assemblies to move up and down relative to the body and/or frame of the vehicle.

One or more axle assemblies of the vehicle may also transfer rotational power and torque provided by an engine of the vehicle to the wheels. For example, the engine may rotationally drive a drive shaft through a transmission assembly. The axle assembly may include a carrier assembly having a pinion gear that is rotationally driven by the drive shaft in meshed engagement with a ring gear. The ring gear is fixed for rotation with a differential that transfers rotational power and torque from the pinion gear to a pair of axle shafts that extend out from the differential in opposite transverse directions. The carrier assembly includes a pinion input bearing used to support the pinion gear. The axle assembly includes an axle housing typically comprising an upper housing half welded to a lower housing half. The carrier assembly is at least partially disposed within the axle housing and fixed thereto.

To meet customer demand, manufacturers provide several different vehicle designs for particular uses. The various axle assemblies exhibit different dimensional characteristics. A major driving factor of the size of the axle housing is its torque transfer capacity. Elements such as a differential housing, differential bearings, and a ring gear are positioned within the axle housing. An open cavity within the axle housing must be appropriately sized. The type of suspension implemented as well as the vehicle track drives the dimensions associated with the elongated and transversely extending portions of the axle assembly.

Today, manufacturing facilities are often equipped with many different presses and sets of stamping/forming dies required to manufacture the plethora of available axle assemblies. The cost of individual die sets and presses is extremely high. A need in the art exists for axle assembly tooling that is easily convertible to produce several different final axle assembly product configurations using a common press and modular tooling.

SUMMARY

This section provides a general summary of the disclosure, and is not a comprehensive disclosure of its full scope or all of its features.

A modular tooling die for an axle housing of a vehicle comprises a post assembly including a plurality of separable post segments positioned adjacent to one another. The post assembly adapted to support a first u-shaped workpiece. A pad assembly is linearly moveable along the first axis for clamping the workpiece to the post. The pad assembly includes a plurality of separable pad segments positioned adjacent to one another. A cam driver assembly is moveable along the first axis and includes a plurality of separable cam driver segments positioned adjacent to one another. A first cam slide assembly is linearly moveable along a second axis that extends perpendicularly to the first axis. A second cam slide assembly is linearly moveable along the second axis in a direction opposite the first cam slide assembly. Each cam driver segment includes a first cam surface and an opposing second cam surface. The first cam surface extends at an angle relative to the first axis outwardly away from the post assembly. The second cam surface extends at an angle relative to the first axis outwardly away from the post assembly. The first cam slide assembly includes separable first cam slide segments. Each first cam slide segment corresponds to one of the cam driver segments and includes a third cam surface facing a corresponding first cam surface, the second cam slide assembly includes separable second cam slide segments. Each second cam slide segment corresponds to one of the cam driver segments and includes a fourth cam surface facing a corresponding second cam surface. The first cam surfaces engage the third cam surfaces and the second cam surfaces engage the fourth cam surfaces to move the first cam slide assembly and the second cam slide assembly toward the post assembly when the cam driver assembly moves toward the first and second cam slides. The first cam assembly and the second cam assembly are configured to shear portions of the first workpiece as they translate toward one another. Each of the post segments, cam driver segments, first cam slide segments, and second cam slide segments that correspond to one another by being coaxially aligned along the first axis are grouped together as die sets. Any one or more of the die sets are replaceable by another die set to account for a second workpiece having different geometry than the first workpiece.

A method of manufacturing an axle housing using a modular tooling die comprises providing first, second and third die sets, determining that the first and second die sets are to be employed for forming a first geometrically predefined shell, placing the first and second die sets in a forming press, positioning the third die set outside of the forming press, positioning a first rectangular metal blank in the forming press, and engaging the first and second die sets with the first metal blank to define the geometrically predefined shell. When a differently shaped or sized axle housing is to be manufactured, the method and modular tooling continues by determining that the first and third die sets are to be employed for forming a second geometrically predefined shell, replacing the second die set with the third die set in the forming press, positioning the second die set outside of the forming press, positioning a second rectangular metal blank in the forming press, and engaging the first and third die sets with the second metal blank to define the second geometrically predefined shell.

DRAWINGS

Other advantages of the present invention will be readily appreciated, as the same becomes better understood by reference to the following detailed description when considered in connection with the accompanying drawings wherein.

DETAILED DESCRIPTION

Figure 1:
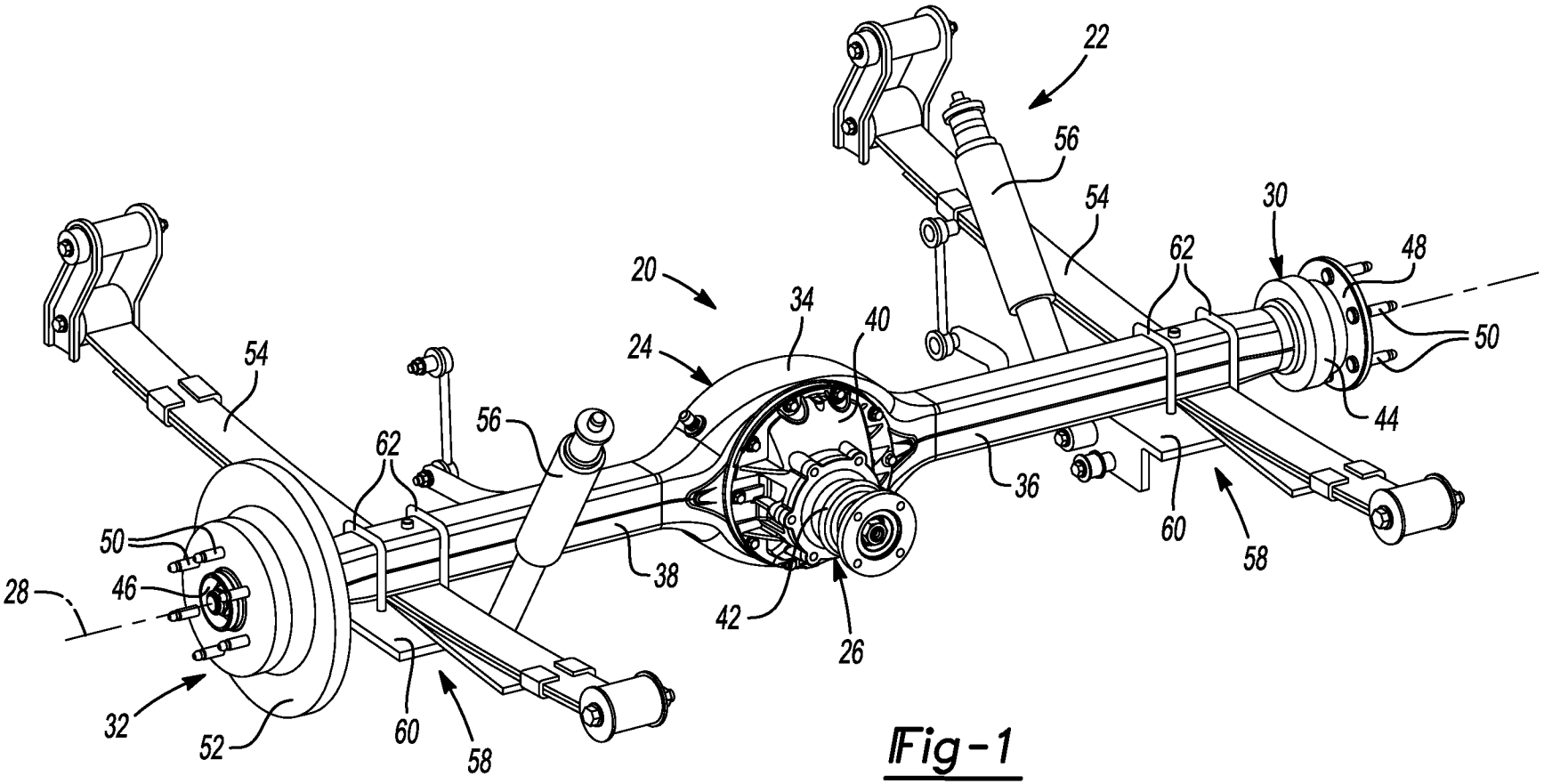
FIG. 1 is a front perspective view of an exemplary axle assembly that has been constructed in accordance with the present disclosure and that is shown in combination with an exemplary suspension system.

Referring to the Figures, wherein like numerals indicate corresponding parts throughout the several views, an axle assembly 20 for a vehicle is illustrated.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 illustrates the axle assembly 20 of the present disclosure connected to an exemplary suspension system 22. The axle assembly 20 includes an axle housing 24 and a carrier assembly 26. The axle housing 24 extends longitudinally along a longitudinal axis 28 between a first wheel end 30 and a second wheel end 32. The axle housing 24 includes a center section 34, a first tubular segment 36 that extends longitudinally between the first wheel end 30 and the center section 34, and a second tubular segment 38 that extends longitudinally between the second wheel end 32 and the center section 34. The carrier assembly 26 includes a carrier housing 40 and a self-lubricating cartridge pinion input bearing 42 that is mounted to the carrier housing 40. A first self-lubricating and unitized grease wheel end bearing 44 is mounted to the first wheel end 30 of the axle housing 24 and a second self-lubricating and unitized grease wheel end bearing 46 is mounted to the second wheel end 32 of the axle housing 24. Each of the first and second self-lubricating and unitized grease wheel end bearings 44, 46 include wheel flanges 48 that are provided with circumferentially spaced wheel studs 50. A brake rotor 52 may be mounted to the wheel flanges 48 with the wheel studs 50 extending through the brake rotor 52. It should therefore be appreciated that the wheels of a vehicle (not shown) may be secured to the wheel flanges 48 of the first and second self-lubricating and unitized grease wheel end bearings 44, 46 by the wheel studs 50.

The suspension system 22 supporting the axle assembly 20 includes a pair of leaf springs 54 and a pair of dampers 56. Both the leaf springs 54 and the dampers 56 are connected to the axle assembly 20 by a pair of shackles 58. The shackles 58 include shackle plates 60 that are clamped to the first and second tubular segments 36, 38 of the axle housing 24 by U-bolts 62. The free ends of the leaf springs 54 and dampers 56 shown in FIG. 1 are configured to bolt to a body or frame of the vehicle (not shown). It should be appreciated that the axle assembly 20 illustrated in FIG. 1 could serve as either a front axle or rear axle of the vehicle.

Figure 2A:
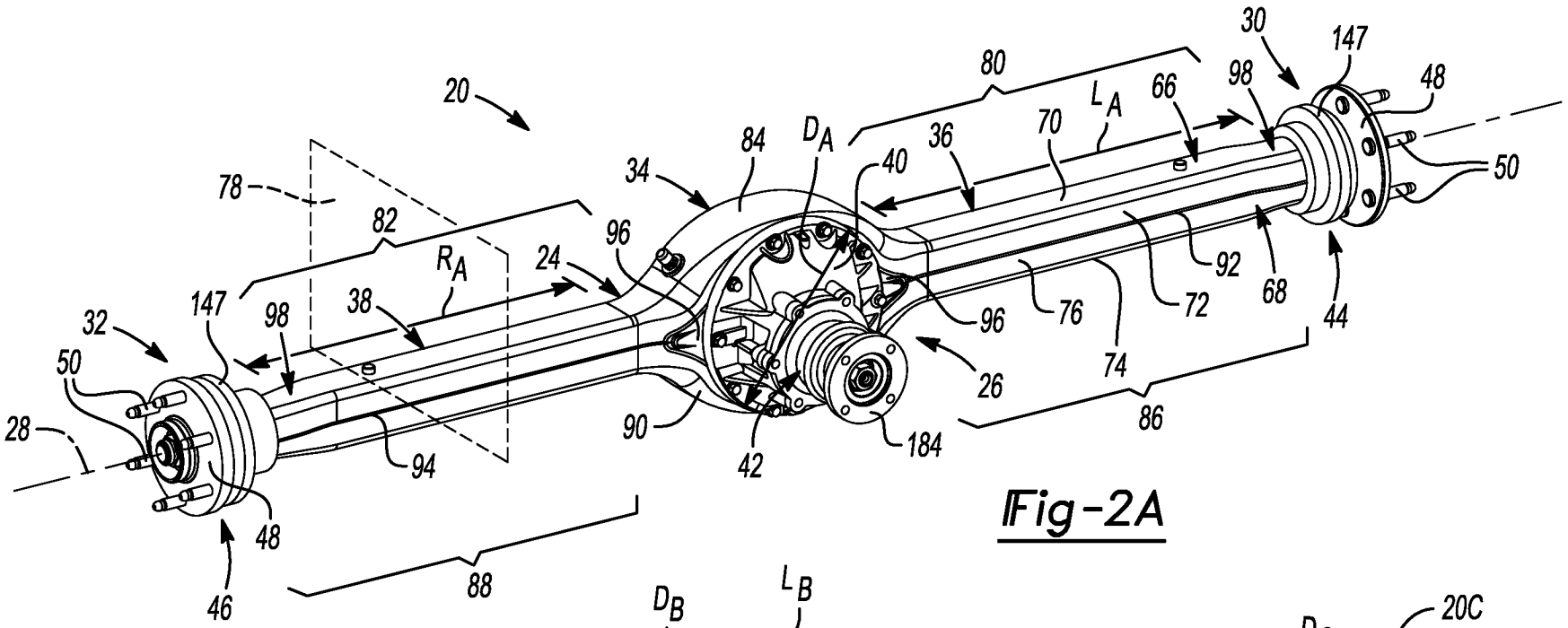
FIG. 2A is a front perspective view of the exemplary axle assembly shown in FIG. 1.
Figure 3:
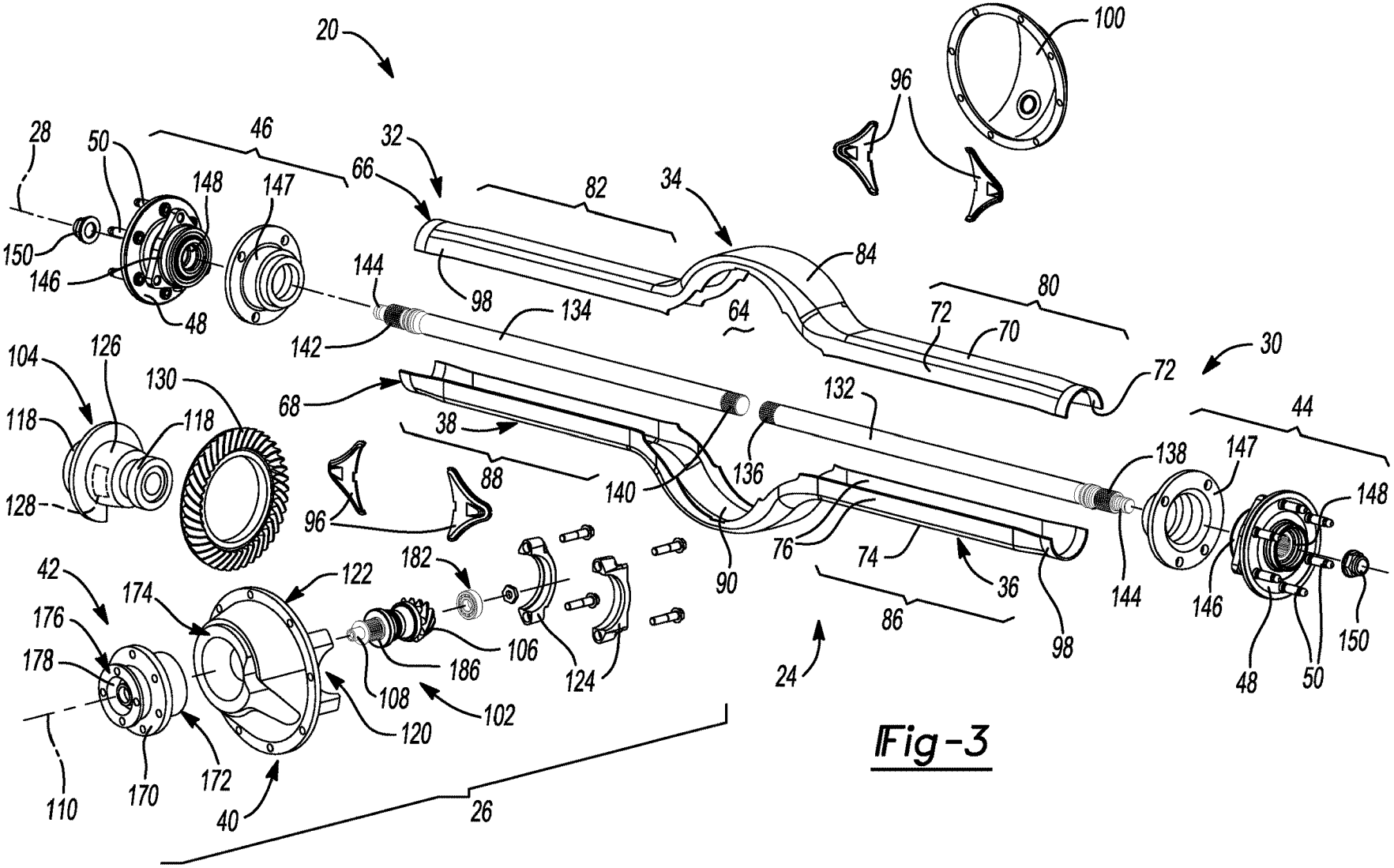
FIG. 3 is an exploded perspective view of the exemplary axle assembly shown in FIG. 1.
Figure 4:
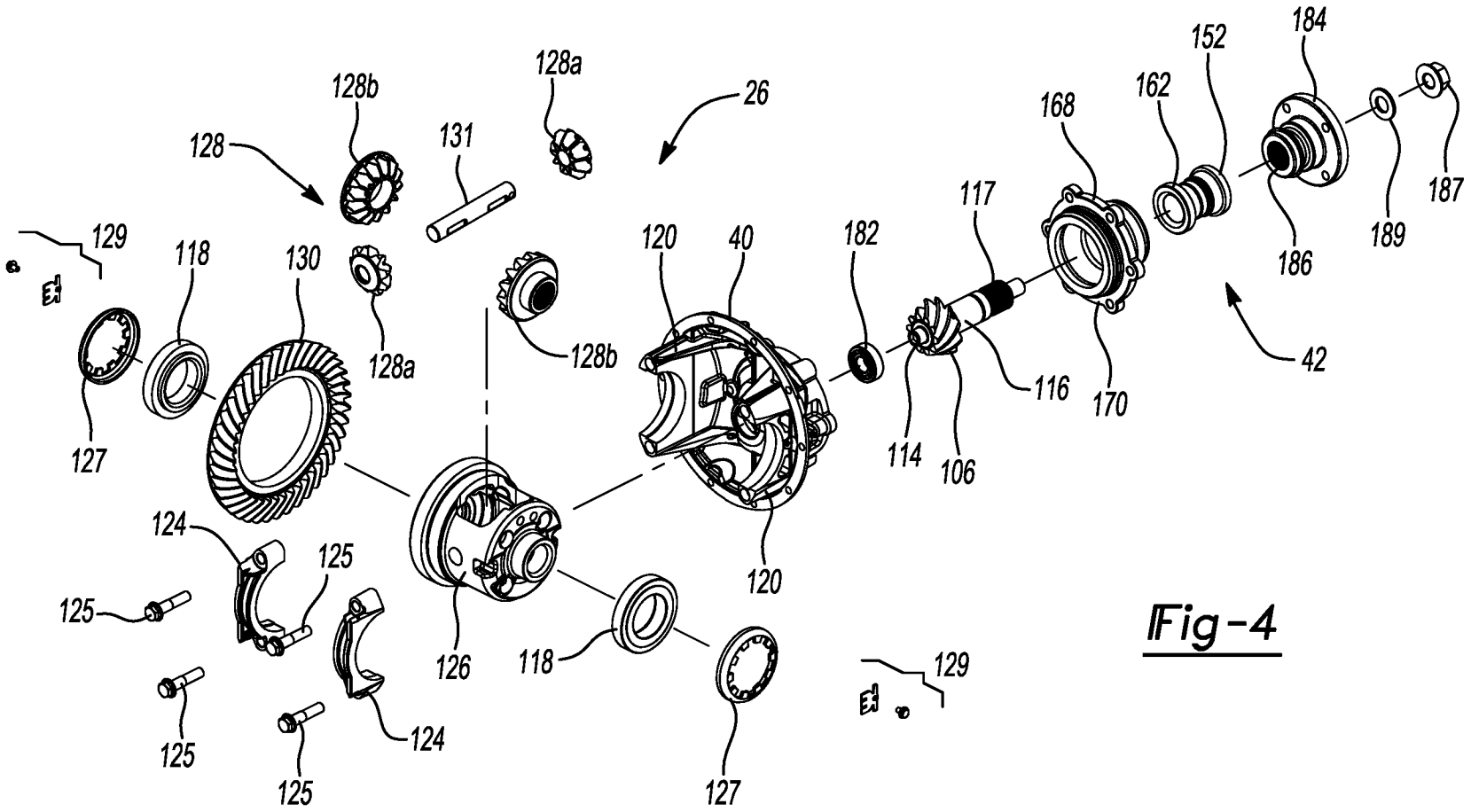
FIG. 4 is an exploded perspective view of a carrier assembly of the exemplary axle assembly shown in FIG. 1.

Referring now to FIGS. 2A, 3 and 4, the center section 34 of the axle housing 24 is hollow, as are the first and second tubular segments 36, 38. The center section 34 and the first and second tubular segments 36, 38 of the axle housing 24 therefore cooperate to define a combined inner volume 64 of the axle housing 24. The axle housing 24 includes an upper beam 66 and a lower beam 68 that are positioned in a clam-shell arrangement. As a result, the upper and lower beams 66, 68 cooperate to form the center section 34 and the first and second tubular segments 36, 38 of the axle housing 24. The upper beam 66 of the axle housing 24 includes an upper wall 70 and a pair of upper beam side walls 72 that extend down from the upper wall 70. The lower beam 68 of the axle housing 24 includes a lower wall 74 and a pair of lower beam side walls 76 that extend up from the lower wall 74. Consequently, the upper and lower beams 66, 68 having opposing U-shaped cross-sections when viewed from the side (i.e., the cross-sections of the upper and lower beams 66, 68 are U-shaped when the cross-sections are taken along a transverse plane 78 that is perpendicular to the longitudinal axis 28).

The upper beam 66 of the axle housing 24 includes a first longitudinal section 80, a second longitudinal section 82, and an upwardly curved section 84 positioned longitudinally between the first and second longitudinal sections 80, 82. The lower beam 68 of the axle housing 24 includes a third longitudinal section 86, a fourth longitudinal section 88, and a downwardly curved section 90 that is positioned longitudinally between the third and fourth longitudinal sections 86, 88. The first longitudinal section 80 of the upper beam 66 cooperates with the third longitudinal section 86 of the lower beam 68 to form the first tubular segment 36 of the axle housing 24. The second longitudinal section 82 of the upper beam 66 cooperates with the fourth longitudinal section 88 of the lower beam 68 to form the second tubular segment 38 of the axle housing 24. The upwardly curved section 84 of the upper beam 66 and the downwardly curved section 90 of the lower beam 68 thus form the center section 34 of the axle housing 24. Although other configurations are possible, the upper and lower beams 66, 68 may be made of metal, such as iron, steel, or aluminum, and the upper beam side walls 72 may be welded to the lower beam side walls 76 at first and second seams 92, 94, which are disposed on opposing sides of the center section 34. Truss plates 96 may also be welded to the upper and lower beam side walls 70, 76 near the center section 34 for added strength and/or ease of manufacturing. A mounting ring 97 is fixed to axle housing 24 by a continuous weld. Threaded mounting holes 99 are circumferentially spaced apart to facilitate coupling carrier assembly 26 to axle housing 24. Optionally, the first and second tubular segments 36, 38 of the axle housing 24 have an inward taper 98 at the first and second wheel ends 30, 32 to accommodate the first and second self-lubricating and unitized grease wheel end bearings 44, 46.

The carrier assembly 26 is housed in the center section 34 of the axle housing 24 and the carrier housing 40 is fixedly mounted to the center section 34 of the axle housing 24. A differential cover plate 100 is also fixedly mounted to the center section 34 of the axle housing 24, opposite the carrier housing 40. Although other configurations are possible, both the carrier housing 40 and the differential cover plate 100 may be made of metal, such as iron, steel, or aluminum, and may be bolted or welded to the axle housing 24. The carrier assembly 26 also includes a pinion 102 and a differential assembly 104.

The pinion 102 includes a pinion gear 106 and a pinion shaft 108 that extends through the carrier housing 40 along a pinion shaft axis 110. The pinion shaft axis 110 extends perpendicularly relative to the longitudinal axis 28 of the axle housing 24 and is spaced from the longitudinal axis 28 by a hypoid offset distance 112 (see FIG. 5). By way of example only and without limitation, the hypoid offset distance 112 may be small, such as 1 to 20 millimeters (mm) and preferably 10 millimeters (mm). This small hypoid offset reduces friction (e.g., scuffing losses) in the pinion gear mesh by approximately 3 percent compared to larger hypoid offset distances in the 35-45 millimeter (mm) range.

If the hypoid offset is reduced to zero, the axes would intersect and the gear arrangement would no longer be considered a hypoid gearset but be labeled as a spiral bevel gearset. For many applications, it is important that at least some hypoid offset is provided to allow the gearset to transmit a higher torque than a similarly sized spiral bevel gearset. The hypoid arrangement also introduces some relative sliding motion across the contact pattern between the pinion gear and the ring gear which produces a quiet gearset during operation. The embodiment of the present disclosure provides an optimized final drive gearset by simultaneously minimizing the hypoid offset to increase mechanical efficiency of the gearset while maintaining a desired amount of hypoid offset to increase torque transfer capacity and reduce noise.

It should be appreciated that the hypoid offset reduction is made possible by implementing a combination of features. The carrier housing 40 is stiffened by integrally forming the carrier housing with a number of particularly sized and positioned ribs to maintain proper position of pinion gear 106. In addition, the loading configuration of the pinion shaft is changed from the typical cantilevered arrangement where both pinion shaft bearings are on one side of the pinion gear to a straddled design where the cartridge bearing is on one side of the pinion gear and a spigot bearing is on the opposite side of the pinion gear. The straddled bearing design in combination with the reinforced carrier housing substantially minimizes the angular deflection imparted on the pinion shaft during torque transmission. The straddled design is described in greater detail below in relation to a spigot bearing and the improved carrier housing is described and depicted at FIGS. 6-10.

Pinion shaft 108 may be configured to include an inboard, or first pinion shaft segment 114 and an outboard, or second pinion shaft segment 116. The pinion gear 106 is positioned axially between the inboard pinion shaft segment 114 and the outboard pinion shaft segment 116 such that the inboard pinion shaft segment 114 protrudes inwardly from the pinion gear 106 and the outboard pinion shaft segment 116 protrudes outwardly from the pinion gear 106 along the pinion shaft axis 110. Pinion shaft 108 includes an eternally splined portion 117.

As shown in FIG. 4, differential assembly 104 is rotatably supported on the carrier housing 40 by a pair of differential bearings 118. As a result, the differential assembly 104 is rotatable relative to the carrier housing 40 about the longitudinal axis 28. The differential bearings 118 are held between a pair of mounting bosses 120*a*, 120*b* that extend from an inboard side 122 of the carrier housing 40 and a pair of caps 124 that extend partially about the differential bearings 118. Although other configurations are possible, the caps 124 may be bolted to the mounting bosses 120*a*, 120*b* of the carrier housing 40 via threaded fasteners 125. Bearing adjustment nuts 127 are rotatable to vary the preload on differential bearings 118. Retainers 129 restrict the adjustment nuts 127 from rotation after the differential bearing preload has been set.

Differential assembly 104 includes a differential body or differential housing 126 and a planetary gearset 128. Planetary gearset 128 includes pinion gears 128*a* drivingly engaged with side gears 128*b*. Pinions gears 128*a* are supported for rotation on a cross-shaft 131. Alternate arrangement differential gearsets, such as parallel axis gears, are contemplated as the gearset shown is merely exemplary.

A ring gear 130 is fixed to the differential housing 126 and arranged in meshing engagement with the pinion gear 106. The ring gear 130 rotates co-axially about the longitudinal axis 28 of the axle housing 24. By way of example and without limitation, the ring gear 130 may be fixed to the differential housing 126 by laser welding instead of by a flanged and bolted connection, which can help reduce weight, eliminate fastener costs, eliminate bolts as a potential failure mode, and reduce churning losses. It should be appreciated that the differential assembly 104 may be any one of the various types of differentials known in the industry, including without limitation, open differentials, limited slip differentials, electronic differentials, and locking differentials.

The axle assembly 20 also includes first and second axle shafts 132, 134 that extend out along the longitudinal axis 28 from opposing sides of the differential assembly 104. The first axle shaft 132 extends longitudinally through the first tubular segment 36 of the axle housing 24 between a first axle shaft inboard end 136 and a first axle shaft outboard end 138. The second axle shaft 134 extends longitudinally through the second tubular segment 38 of the axle housing 24 between a second axle shaft inboard end 140 and a second axle shaft outboard end 142. The first and second axle shaft inboard ends 136, 140 and the first and second axle shaft outboard ends 138, 142 are splined. The first and second axle shaft outboard ends 138, 142 may also include threaded portions 144. The first and second axle shaft inboard ends 136, 140 are received in the differential assembly 104 and are rotationally coupled to the pinion gear 106 through the planetary gearset 128.

The axle assembly 20 of the present disclosure uniquely includes a self-lubricating bearing arrangement that includes the combination of a self-lubricating cartridge pinion input bearing 42 with first and second self-lubricating and unitized grease wheel end bearings 44, 46. In accordance with this arrangement, the outboard pinion shaft segment 116 is rotatably supported by the self-lubricating cartridge pinion input bearing 42, which is mounted to the carrier housing 40 and allows the pinion 102 to rotate relative to the carrier housing 40 about the pinion shaft axis 110. The first axle shaft outboard end 138 is rotatably supported by the first self-lubricating and unitized grease wheel end bearing 44, which is mounted to the first wheel end 30 of the axle housing 24. The second axle shaft outboard end 142 is rotatably supported by a second self-lubricating and unitized grease wheel end bearing 46, which is mounted to the second wheel end 32 of the axle housing 24. As a result, the first and second axle shafts 132, 134 can rotate within the axle housing 24 about the longitudinal axis 28.

As explained above, wheel flanges 48 of the first and second self-lubricating and unitized grease wheel end bearings 44, 46 have circumferentially spaced wheel studs 50. Wheel flanges 48 are connected to and rotate with an inner race 146 of the first and second self-lubricating and unitized grease wheel end bearings 44, 46. The inner races 146 include splined bores 148 that receive the first and second axle shaft outboard ends 138, 142 such that the splines on these respective components rotatably couple the inner races 146 and thus the wheel flanges 48 to the first and second axle shafts 132, 134. Because the splines on the first and second axle shaft inboard ends 136, 140 mate with the differential assembly 104, which is rotatably driven by the ring gear/pinion gear mesh, the rotational power and torque of the engine can be transmitted to the wheels of the vehicle. The first and second self-lubricating and unitized grease wheel end bearings 44, 46, also include outer races 147 that extend annularly about the inner races 146. The outer races 147 are fixedly mounted to the first and second wheel ends 30, 32 of the axle housing 24, such as by welding or a bolted connection. Greased bearings (not shown) may be provided between the inner and outer races 146, 147 to reduce friction. These greased bearings could be tapered roller bearings, high contact ball bearings, or a combination of tapered roller bearings and high contact ball bearings depending on the desired load rating. Wheel end nuts 150 thread onto the threaded portions 144 of the first and second axle shaft outboard ends 138, 142 to prevent free play along the longitudinal axis 28 between the wheel flanges 48 and the first and second axle shafts 132, 134.

In accordance with this design, the first and second axle shafts 132, 134 are provided in a full floating arrangement, where both the first and second axle shaft inboard ends 136, 140 and both the first and second axle shaft outboard ends 138, 142 have splined connections and are supported by bearings 44, 46, 118. This full floating arrangement provides better support for the first and second axle shafts 132, 134, which reduces binding and distributes loading between multiple bearings 44, 46, 118 for improvements in mechanical efficiency and durability.

Figure 2C:
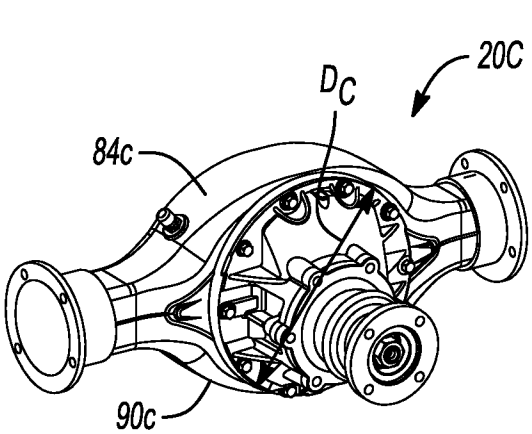
FIG. 2C is a front perspective view of another exemplary axle assembly.
Figure 2B:
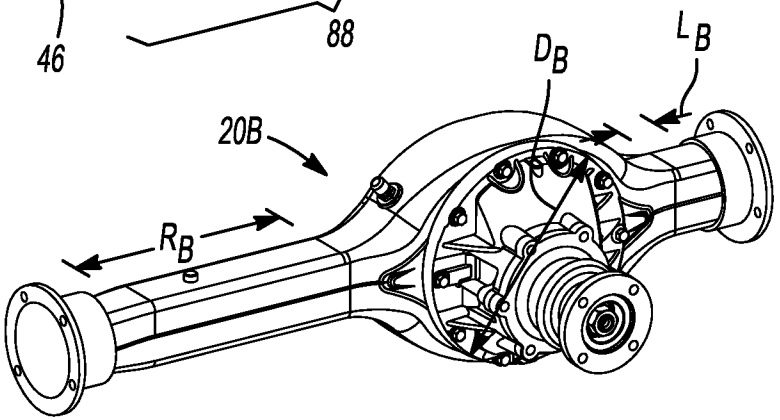
FIG. 2B is a front perspective view of another exemplary axle assembly.

With reference to FIGS. 2A, 2B and 2C, three different exemplary axle assemblies 20, 20B and 20C are illustrated. As previously described, axle assembly 20 includes first longitudinal section 80 having a length LA, second longitudinal section 82 having a length RA and upperwardly curved section 84 coupled to downwardly curved section 90 that in combination define a diameter DA. In the embodiment depicted in the FIG. 2A length LA is substantially the same as RA but this is not necessarily the case in all instances. For example, axle assembly 20B includes a longitudinal section length LB substantially less than the opposing leg length RB. FIG. 2B depicts an axle having an increased torque transfer rating as compared to the axle depicted in FIG. 2A. As such, the carrier assembly and the associated axle housing center section diameter DB is greater than DA. In yet another arrangement, axle assembly 20C effectively includes only upperwardly curved section 84C fixed to downwardly curved section 90C. The length of the first and second longitudinal sections are effectively zero or a relatively short distance.

Figure 5A:
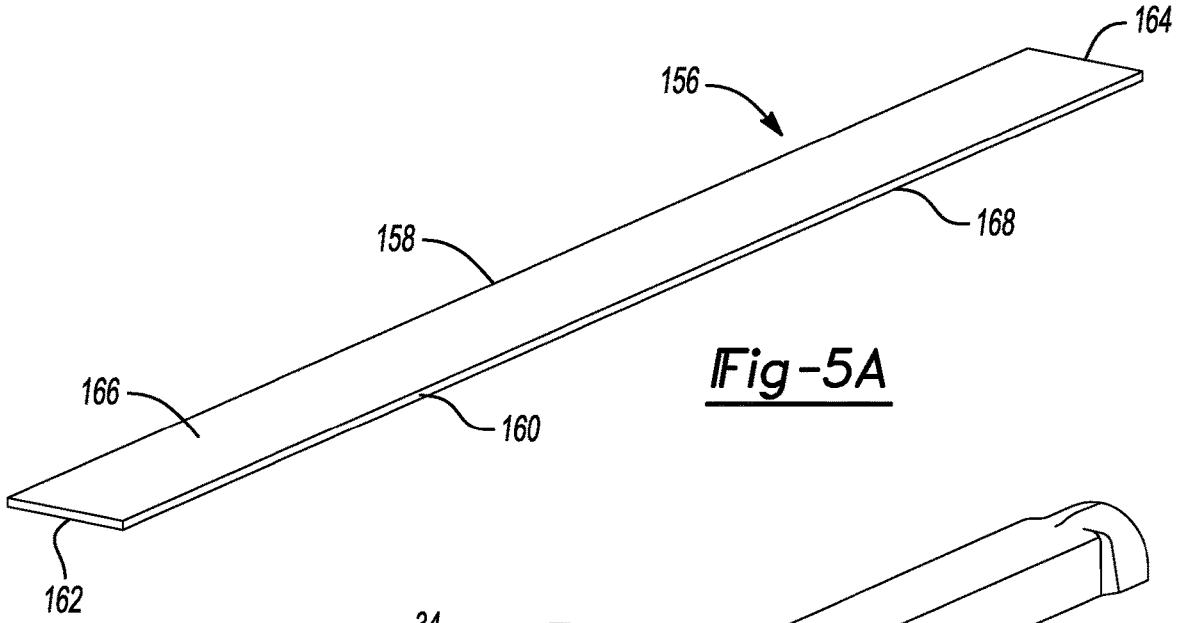
FIG. 5A is a perspective view of a rectangularly shaped metal blank.
Figure 5B:
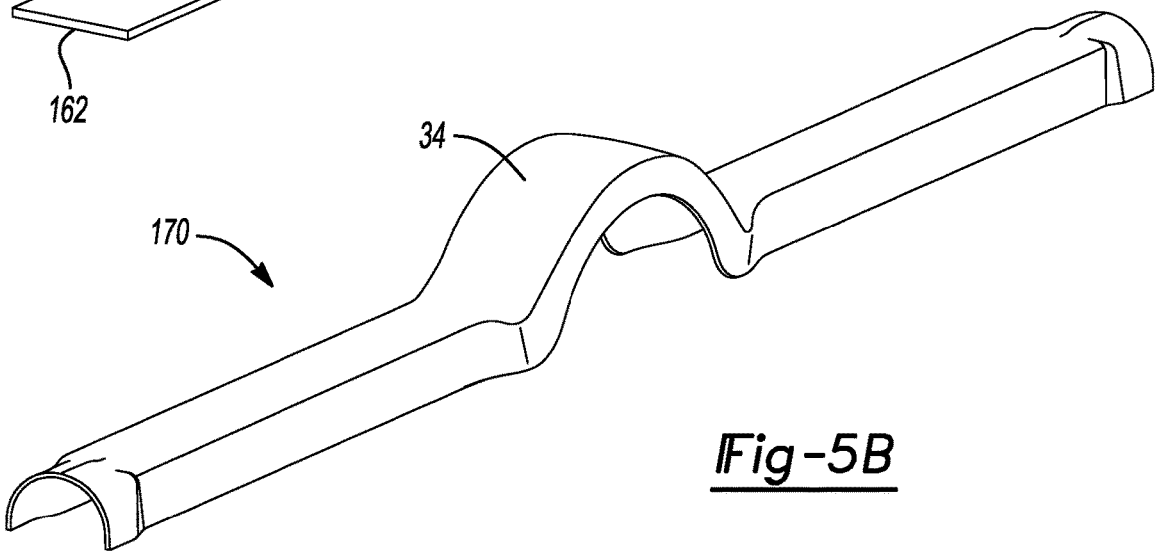
FIG. 5B is a perspective view of a metal shell having completed the forming process.
Figure 5C:
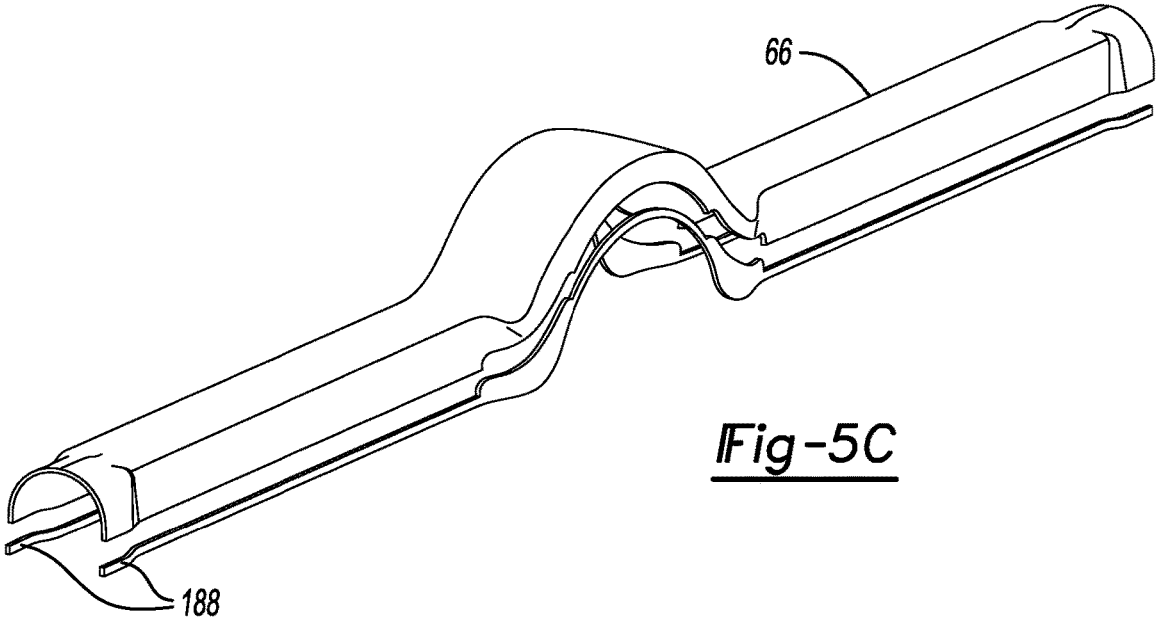
FIG. 5C is a perspective view depicting an upper beam and scrap portions separated from the upper beam by a trimming process.

FIGS. 5A, 5B and 5C depict work-in-process stages associated with manufacturing steps of the present disclosure to form upper beam 66 in a final configuration prior to welding to lower beam 68. FIG. 5A depicts a rectangular plate 156 having parallel edges 158, 160 that define a width as well as parallel interfaces 162, 164 that define a length of plate 156. Parallel opposite surfaces 166, 168 define a thickness of plate 156. It should be appreciated that plate 156 may be provided by simply de-coiling a portion of a metal roll and cutting one of the edges to define a length or a width of the plate 156.

Figure 6:
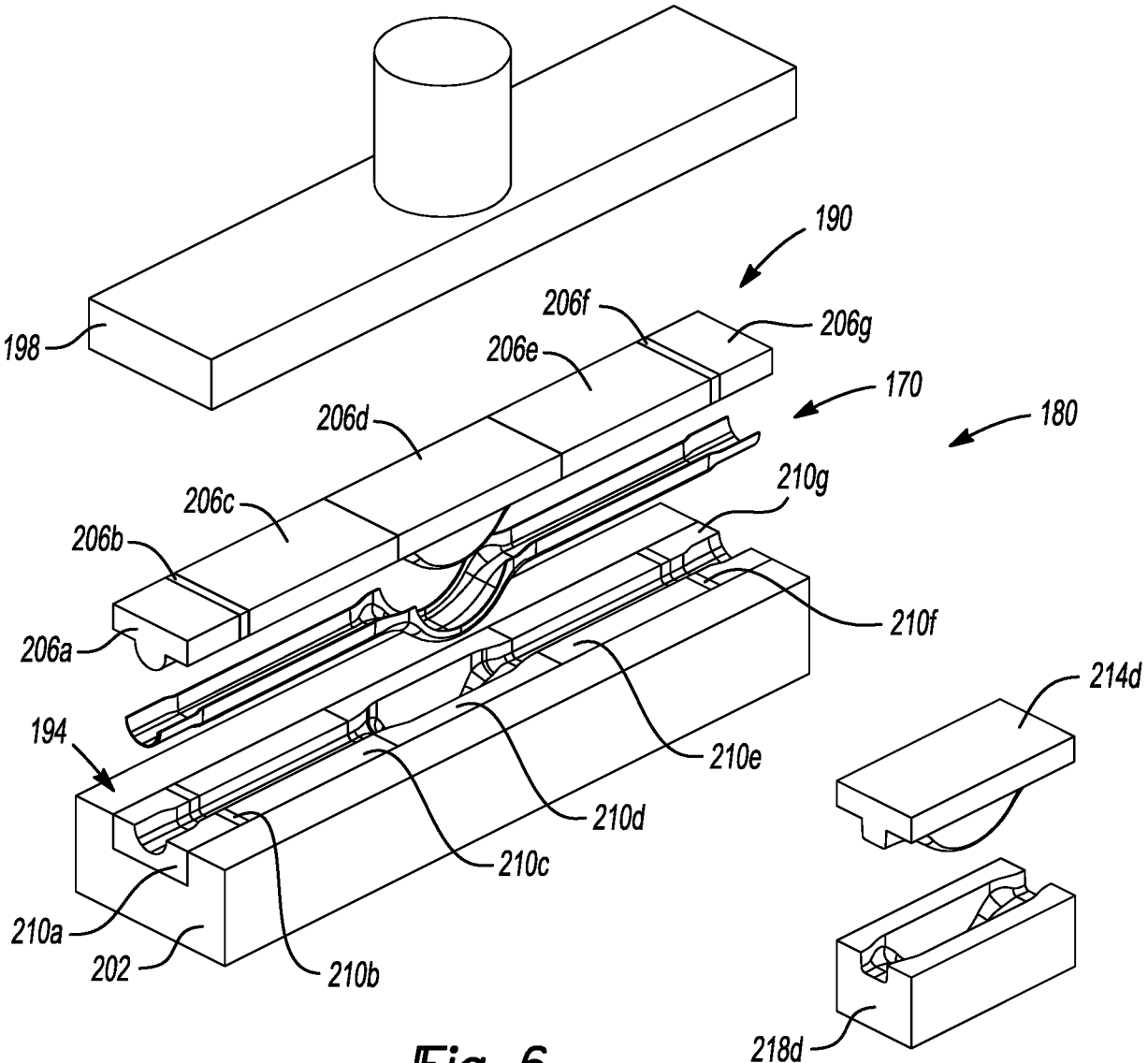
FIG. 6 is a perspective view depicting a forming die for defining the geometry of the shell depicted in FIG. 5B.
Figure 7:
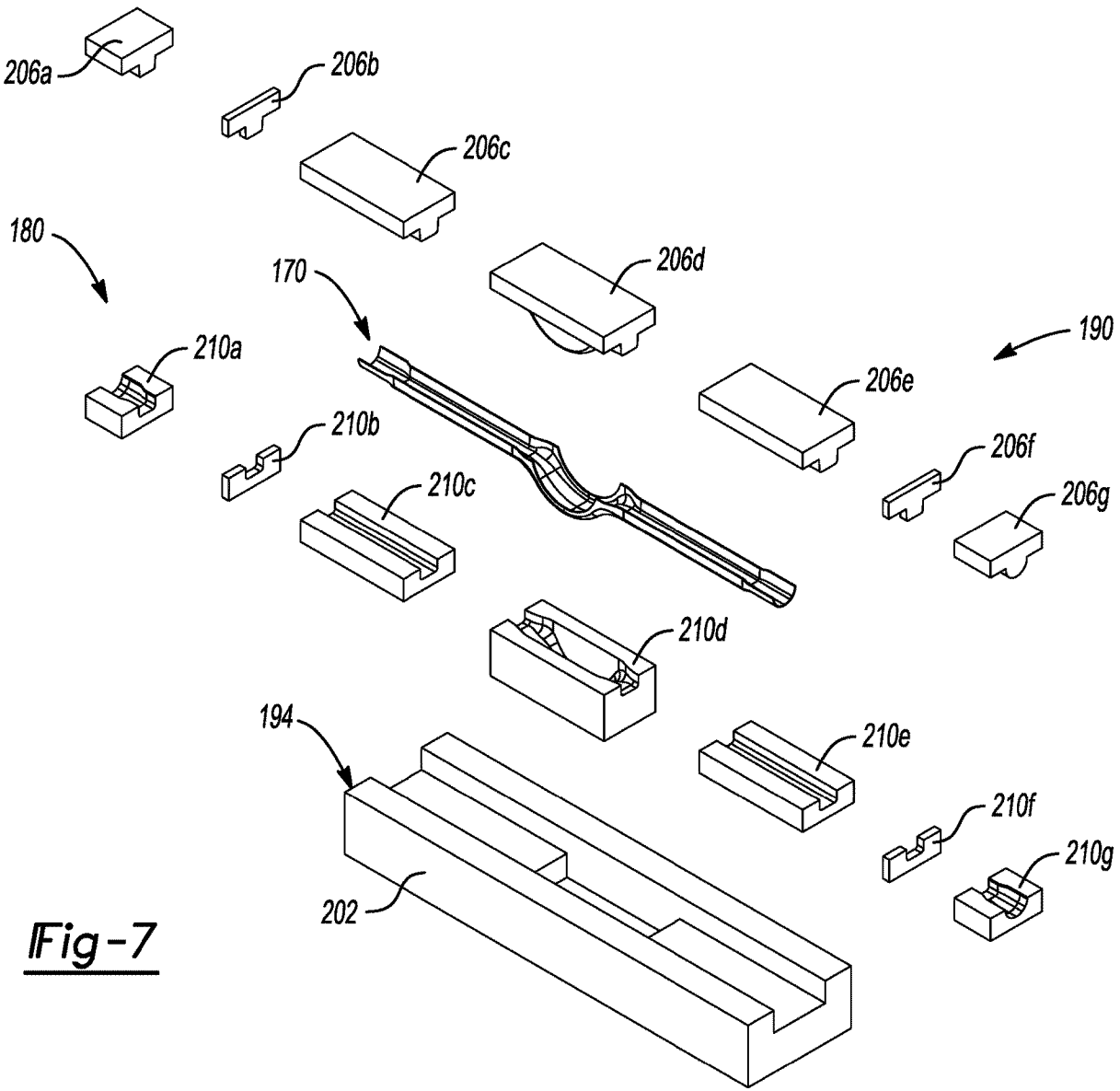
FIG. 7 is an exploded perspective view of the forming die of FIG. 6.

FIG. 5B depicts a formed shell 170 that has been shaped by a forming die 180 shown in FIGS. 6 and 7. Forming die 180 performs a stamping operation to impart complex shapes to previously planar plate 156. Shell 170 includes a majority of the features of upper beam 66 including first longitudinal section 80, second longitudinal section 82, upwardly curved section 84 and inward taper 98. Shell 170 includes excess material along the edges of upper beam sidewalls 72 which is subsequently removed in a trim die 186 depicted FIGS. 8-11. FIG. 5C illustrates the finalized upper beam 66 positioned adjacent to two pieces of scrap 188 removed from shell 170 during the trimming operation performed by trim die 186.

Figure 8:
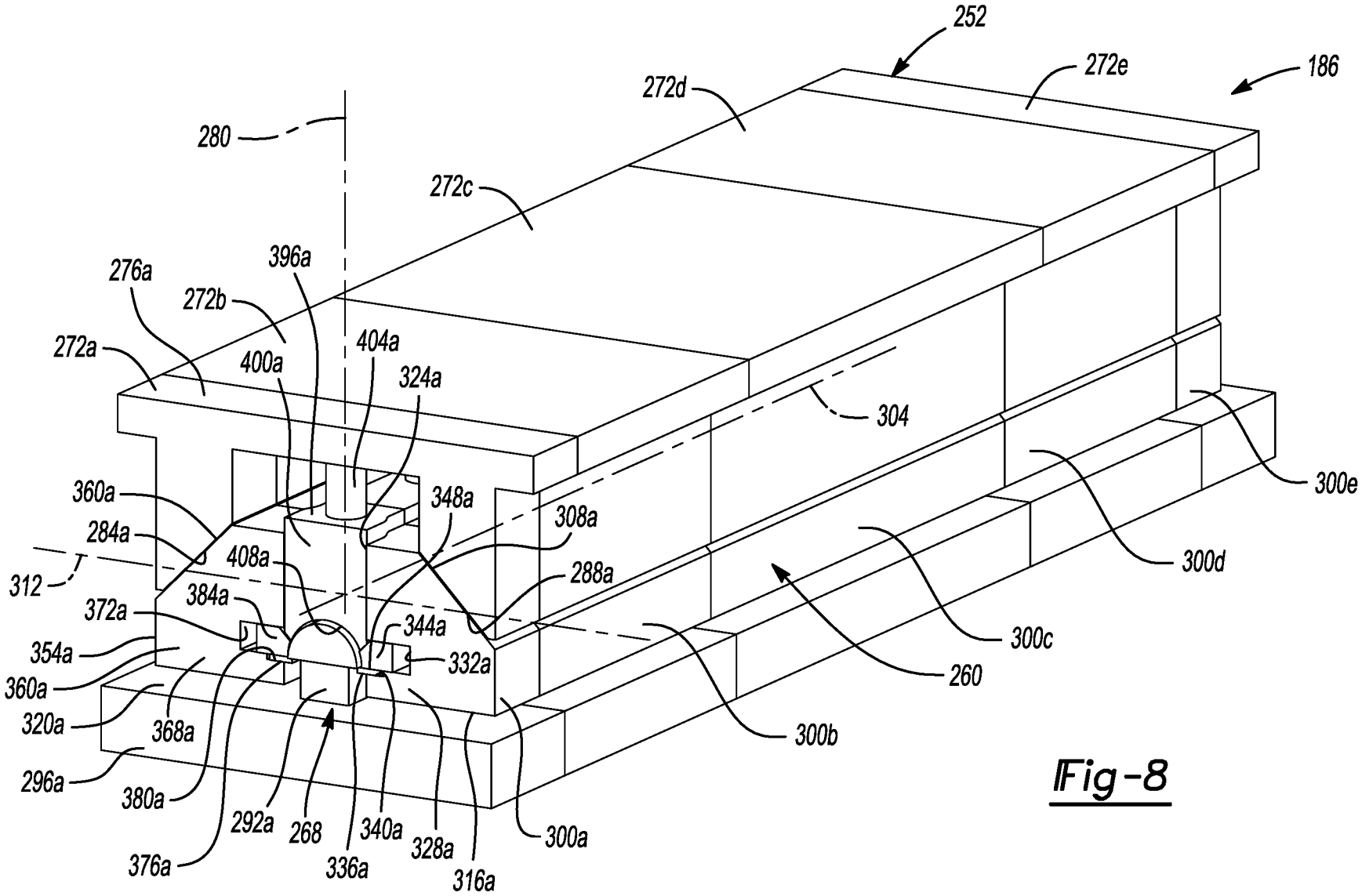
FIG. 8 is a perspective view of a trim die operable to remove the scrap portions from the shell as illustrated in 5C.

FIGS. 7 and 8 depict a modular forming die 180 including an upper die assembly 190 and a lower die assembly 194 positioned between a ram 198 and a bed 202. It should be appreciated that the terms "upper" and "lower" are merely used for convenience. Ram 198 need not be vertically oriented relative to ground but may be oriented in this manner to utilize gravitational forces.

Upper die assembly 190 includes a plurality of individual removable upper dies 206*a*, 206*b*, 206*c*, 206*d*, 206*e*, 206*f*, and 206*g*. Lower die assembly 194 includes a plurality of individual removable lower dies 210*a*, 210*b*, 210*c*, 210*d*, 210*e*, 210*f*, and 210*g*. Upper dies and lower dies with the same suffix form a pair to impart a predefined geometry on plate 156 and define an associated portion of shell 170. During operation, ram 198 is fixed to upper die assembly 190 while lower die assembly 194 fixed to bed 202. Upper die assembly 190 is spaced apart from lower die assembly 194 by axially translating ram 198 away from bed 202. Plate 156 is inserted between upper die assembly 190 and lower die assembly 194 while the die assemblies are spaced apart. Ram 198 is axially translated toward bed 202 to drivingly engage upper die assembly 190 with plate 156. As ram 198 axially translates toward bed 202, partially formed plate 156 engages lower die assembly 194. Upon completion of translation of ram 198, shell 170 is completely defined. The formed shell 170 is removed after ram 198 axially translates away from bed 202 sufficient amount.

As previously described, several dimensional characteristics of shell 170, including the size and shape of upwardly curved section 84, first longitudinal section 80, second longitudinal section 82, and inward taper 98, may be changed by replacing a given upper and lower die set with an alternate upper and lower die set. For example, FIG. 6 depicts upper die 206*d* configured to cooperate with lower die 210*d* to define the size and shape of upwardly curved section 84. Upper die assembly 190 and lower die assembly 194 may be reconfigured in a relatively simple manner if a differently shaped shell 170 is required. It is contemplated that the same ram 198 and bed 202 may be used to form differently dimensioned shells 170.

If it is desirable to form a shell 170 having a differently sized carrier assembly than previously formed, the geometry of upwardly curved section 84 will also change. A replacement die set including an upper die 214*d* and a lower die 214*e*, having appropriately revised dimensions, will replace upper die 206*d* and lower die 210*d*. If the size and shape of the first longitudinal section 80 and second longitudinal section 82 remain the same as the previous shell, no need exists to change out pairs of dies 206*c*, 210*c* or 206*e*, 210*e*. On the contrary, if the size or shape of the longitudinal sections have changed, these die sets may also be replaced. It should be appreciated that a quick-change manufacturing environment may be provided by maintaining various pairs of upper and lower forming dies to define a virtually unlimited number of axial housings. In the embodiment shown in FIG. 6, the length of upper die 206*c* is substantially the same as upper die 206*e*. This is not always the case. To create axle assembly 20B, as depicted in FIG. 2B, one of the pairs of dies would be substantially shorter than the other.

To minimize the number of die sets required to manufacture several different axle housings, it may be beneficial to incorporate a set of shim sets similar to upper die 206*b*, 210*b* as well as 206*f*, 210*f*. If a minimum axle leg length (longitudinal section length) is known, die sets 206*c*, 210*c* and 206*e*, 210*e* may be formed at this minimum length. Axle assemblies that require longer longitudinal sections legs would be manufactured using upper die assemblies and lower die assemblies that include one or more shim sets such as 206*b*, 210*b*.

A desired end configuration of a given axle housing may vary from square, round, or rectangularly-shaped. The end shape is defined by die sets comprising upper dies 206*a*, 210*a* and 206*g*, 210*g*. Once again, these end configuration die sets are easily removable and replaced with other die sets as desired.

In yet another example, it may be desirable to construct an axle housing having an increased wall thickness. To change the material wall thickness of shell 170, an increased plate 156 is supplied. Replacement die sets having increased clearance would be inserted to account for the increased plate thickness.

With reference to FIGS. 8-11, trim die 186 is operable to shear scrap portions 188 from shell 170 to define finalized upper beam 66. A need exists for trim die 186 because the cutting operation to remove scrap portions 188 occurs 90° to the direction in which ram 198 of forming die 180 travels. Trim die 186 includes a cam driver assembly 252, a spring pad assembly 256, a first cam slide assembly 260, a second cam slide assembly 264, and a post assembly 268. Cam driver assembly 252 includes separable cam driver segments 272*a*, 272*b*, 272*c*, 272*d*, and 272*e* positioned adjacent to one another. Each cam driver segment is substantially similar to each other. Accordingly, only cam 272*a* will be described in detail. Cam driver segment 272*a* includes a driven surface 276*a* that is substantially planar and configured to be contacted by a ram of a press to axially translate cam driver segment 272*a* linearly along a first axis 280. It should be appreciated that the linear translation of any one of cam driver segments 272*a-e* is deemed to move along the same direction as any similar axis extending parallel to first axis 280. First axis 280 may be also considered to extend along a vertical direction.

Cam driver segment 272*a* includes a first cam surface 284*a* and an opposing second cam surface 288*a*. Each of the first and second cam surfaces 284*a*, 288*a* extend at an angle relative to first axis 280 outwardly away from a post 292*a* of post assembly 268 and toward base 296*a* of post assembly 268. It is contemplated that first cam surface 284*a* intersects first axis 280 at a 45 degree angle. Similarly, second cam surface 288*a* intersects first axis 280 at a 45 degree angle. These angles are exemplary as other angular arrangements may be implemented.

First cam slide assembly 260 includes a plurality of individual and separable first cam slide segments 300*a*, 300*b*, 300*c*, 300*d*, and 300*e* positioned adjacent to one another. Each cam driver segment 272*a-e* includes a width as measured along a second axis 304 that extends perpendicularly to first axis 280. Each first cam slide segment 300*a*-300*e* has a width matching the opposing and corresponding cam driver segment 272*a*-272*e*. Each first cam slide segment is substantially similar to each other. Accordingly, only first cam slide segment 300*a* will be described in detail.

First cam slide segment 300*a* includes a third cam surface 308*a* that extends at an angle complimentary to the angle along with which second cam surface 288*a* extends. Accordingly, third cam surface 308*a* extends parallel to second cam surface 288*a*. This arrangement of drive and driven surfaces causes first cam slide 300*a* to axially translate along a third axis 312 toward post 292*a* when cam driver segment 272*a* is translated along first axis 280 toward post 292*a*. It should be appreciated that third axis 312 perpendicularly extends to both first axis 280 and second axis 304. First cam slide segment 300*a* includes a bottom surface 316*a* which rests on an upper surface 320*a* of base 296*a*. Relative sliding movement between the surfaces occurs during operation of trim die 186.

First cam slide segment 300*a* includes a stop face 324*a* a shear support portion 328*a* and a recess 332*a*. A knife 336*a* is fixed to first cam slide segment 300*a* and positioned within a rabbet 340*a* formed in shear support portion 328*a*. A translatable first cam pad 344*a* is positioned within recess 332*a*. First cam pad 344*a* is biased toward post 292*a* and slidable along an upper surface 348*a* of knife 336*a*.

Second cam slide assembly 264 is configured as the mirror image of first cam slide assembly 260 and includes a plurality of individual and separable second cam slide segments 354*a*, 354*b*, 354*c*, 354*d* and 354*e* positioned adjacent to one another. Each second cam slide segment 354*a-e* has a width matching the opposing and corresponding first cam slide segment 300*a-e* as well as the corresponding cam driver segment 272*a-e*. Second cam slide segment 354*a* includes a fourth cam surface 360*a* that extends at an angle complimentary to the angle which first cam surface 284*a* extends. Fourth cam surface 360*a* extends parallel to first cam surface 284*a* such that second cam slide segment 354*a* is axially driven along third axis 312 toward post 292*a* when cam driver segment 272*a* is translated along first axis 280 toward post 292*a*. Second cam slide segment 354*a* includes a stop face 364*a*, a shear support portion 368*a*, and a recess 372*a*. A knife 376*a* is fixed to second cam slide segment 354*a* and positioned within a rabbet 380*a* formed in shear support portion 368*a*. A translatable second cam pad 384*a* is positioned within recess 372*a*. Second cam pad 384*a* is urged toward post 292*a* by mechanism such as a spring (not shown).

Spring pad assembly 256 includes a plurality of individual and separable spring pad segments 396*a*, 396*b*, 367*c*, 396*d* and 396*e* positioned adjacent to one another. Each spring pad is substantially similar to each other. Only spring pad segment 396*a* will be described in detail. Spring pad segment 396*a* includes a piston 398*a* and a body 400*a* urged toward 290*a* by a spring 404*a*. Body 400*a* includes an engagement surface 408*a* that is driven into contact with an upper surface of shell 170 to clamp shell 170 at desired location on post 292*a*.

Figure 9:
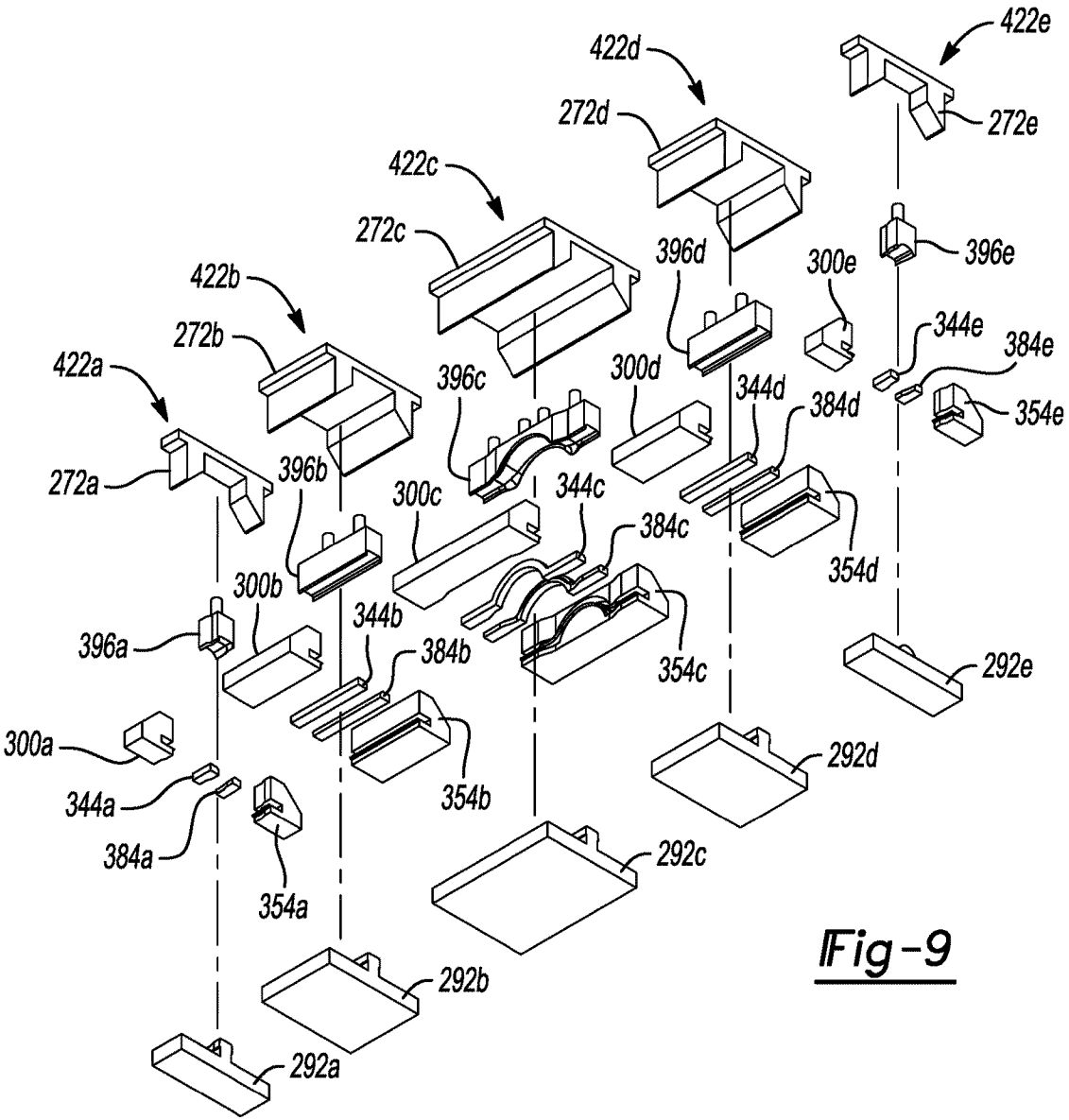
FIG. 9 is an exploded perspective view of the trim die.

FIG. 9 depicts groups of components of trim die 186 that define replaceable die sets. As previously described with reference to forming die 180, trim die 186 is configurable to perform trimming operations on a variety of shells having different geometry. Certain portions of shell 170 may be dimensionally the same as portions of another shell 170 while the remaining portions may have different dimensional characteristics. For example, center section 34 of a certain shell 170 may be formed to a predefined draw depth to mate with a particularly sized carrier assembly. FIG. 9 depicts a plurality of die sets 422*a*, 422*b*, 422*c*, 422*d*, and 422*e* that are replaceable as modules of tooling sized to define the final features of a particular upper beam 66.

Figure 10:
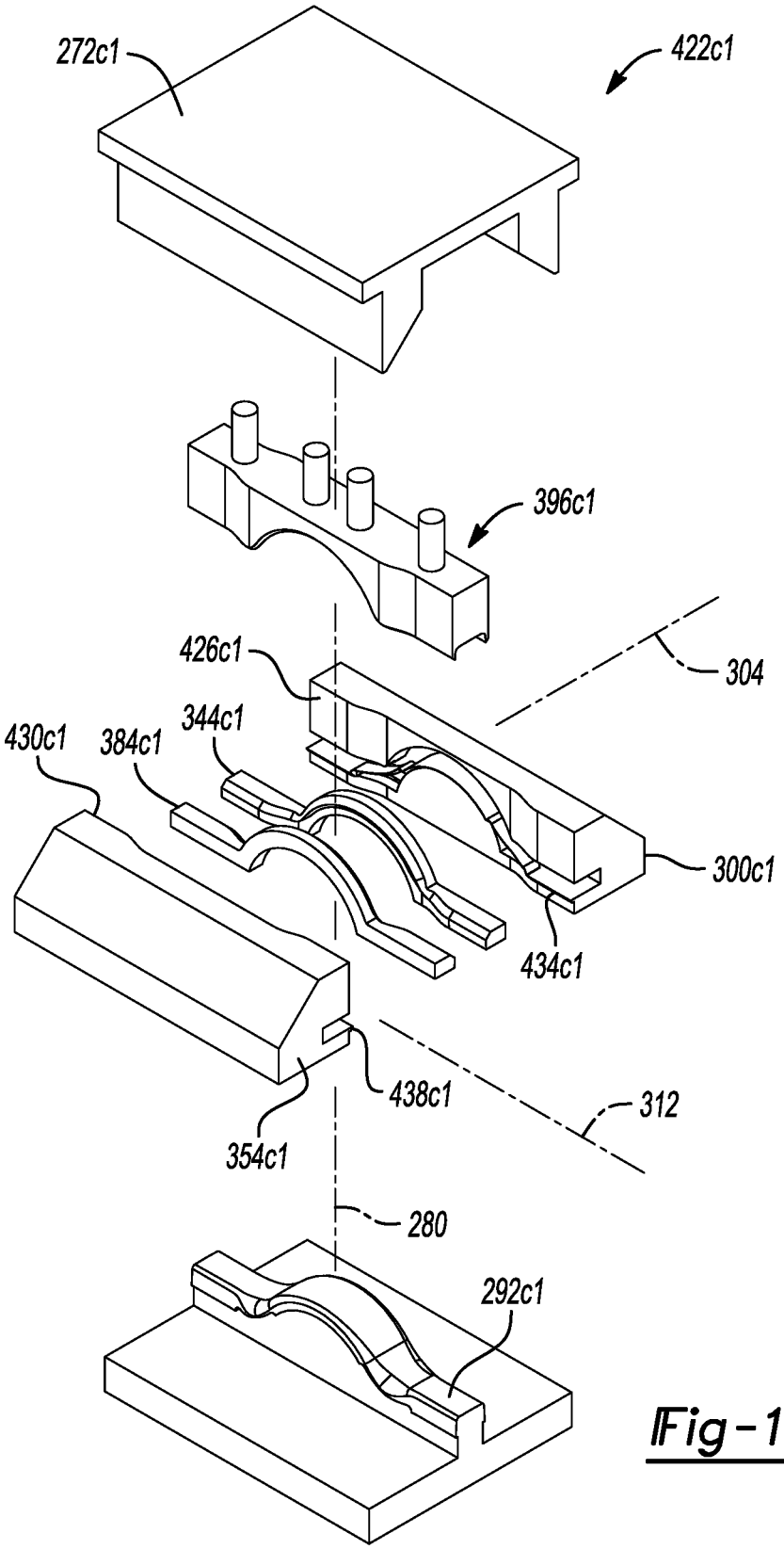
FIG. 10 is an exploded perspective view of a portion of the trim die.

FIG. 10 depicts a replacement central die set 422*c*1 configured to trim portions of a differently sized shell 170 that accepts a differently sized carrier assembly. Elements of central die set 422*c*1 will be identified with a numeral "1" suffix. In the center section of upper beam 66, portions of the beam side walls may extend in a three-dimensional manner. As such, the portions of die set 422*c* or 422*c*1 that engage shell 170 also exhibit a complex shape. First cam slide segment 300*c*1 and second cam slide segment 354*c*1 include stepped faces 426*c*1, 430*c*1, respectively that vary in the second axis 304 direction. Accordingly, knives 434*c*1, 438*c*1 include three-dimensional contours with respect to first axis 280, second axis 304 and third axis 312. First cam pad 344*c*1 and second cam pad 384*c*1 also exhibit complex three-dimensional shapes since each of the trim die components cooperate with one another. Post 292*c*1 is defined by a three-dimensionally complex shape to support shell 170 and provide reaction surfaces during the shearing action opposite cutting surfaces 434*c*1, 438*c*1.

Figure 11:
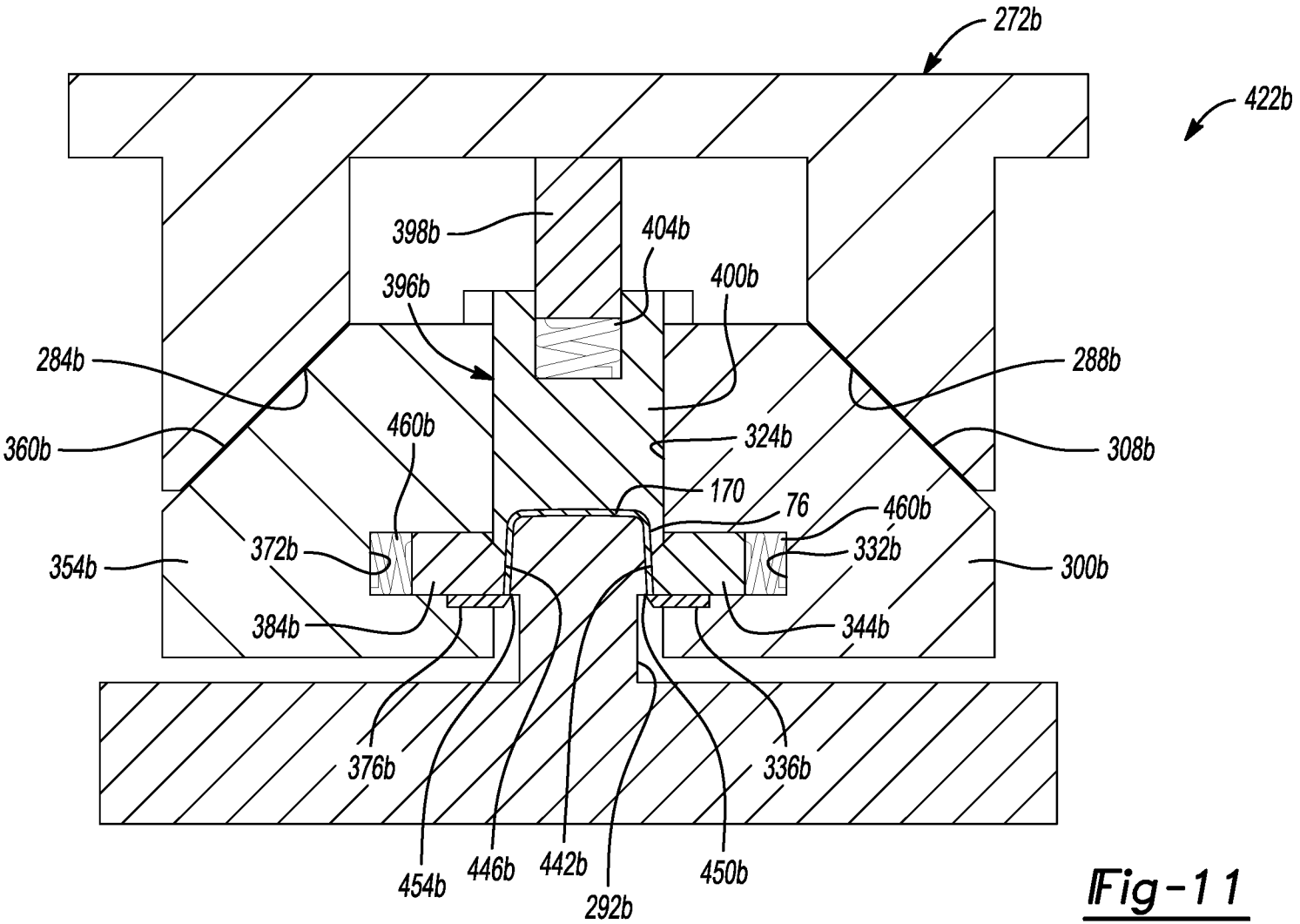
FIG. 11 is a cross-sectional view of the trim die depicting a trimming operation.

FIG. 11 provides a cross-sectional view through die set 422*b*. In a production manufacturing environment, trim die 186 is configured to remove portions of material from shell 170 having a particular geometrical configuration. Based on the geometry of shell 170, an operator selects the particular die sets that are to be positioned adjacent to one another in trim die 186 based on the geometry of the shell to be processed. It is contemplated that a tool room would be equipped with several different die sets in addition to 422*a*-422*e* and 422*c*1. Once the appropriate die sets are loaded into the press, a workpiece such as shell 170 is positioned in engagement with post assembly 268. At this time, cam driver assembly 252 as well first cam slide assembly 260 and second cam slide assembly 264 are positioned in their retracted positions spaced apart from post assembly 268. In contrast, it should be appreciated that FIG. 11 depicts each of the components of die set 422*b* at their fully extended positions after the completion of the trimming operation.

Returning to the description of operation of trim die 186, once the un-trimmed shell 170 is placed on top of post assembly 268, cam driver assembly 252 and spring pad assembly 256 are linearly translated toward post assembly 268. For ease of explanation, the elements of die set 422*b* will be described in view of FIG. 11. The other adjacent portions of trim die 186 act accordingly. The trimming process continues by engaging spring pad segment 396*b* with shell 170 to clamp the shell to post 292*b*. Spring 404*b* urges body 400*b* away from piston 398*b* to drivingly engage body 400*b* with shell 170. Based on the inclusion of spring 404*b*, cam driver segment 272*b* may continue to move toward post 292*b* after body 400*b* engages shell 170.

First cam surface 284*b* engages fourth cam surface 360*b* at substantially the same time as second cam surface 288*b* engages third cam surface 308*b*. At this time, first cam slide segment 300*b* and second cam segment 354*b* are simultaneously translated toward shell 170. Because first cam pad 344*b* and second cam pad 384*b* are coupled to their respective first and second cam slide segments 300*b*, 354*b*, these elements also translate toward shell 170.

As the manufacturing process continues, and end face 442*b* of first cam pad 344*b* engages one of beam sidewalls 72 and presses the sidewall against post 292*b* to straighten and properly align the sidewall. Similarly, a second end face 446*b* of second cam pad 384*b* engages an opposite beam sidewall 76 and traps the opposite side wall against post 292*b* to straighten and properly align the sidewall. At this moment of manufacturing, end faces 442*b*, 446*b* are positioned inwardly closer to post 292*b* than the cutting edge 454*b* of knife 376*b* and a cutting edge 450*b* of knife 336*b*. As cam driver assembly 252 continues to translate toward post assembly 292, springs 460, hydraulic rams or some other devices are positioned within recesses 332*b*, 372*b* allow cutting edges 450, 454*b* to approach and cut through upper beam sidewalls 72 while first and second cam pads 344*b*,384*b* maintain engagement with shell 170. As cutting edges 450*b*, 454*b* sheer through the material, scrap pieces 188 are separated from shell 170. The process is finalized by retracting cam driver assembly 252, first cam slide assembly 260, spring pad assembly 256 and second cam assembly 264. The finalized upper beam 66 and scrap pieces 188 are removed from the trim die 186 to allow trimming of a subsequently inserted shell 170.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. These antecedent recitations should be interpreted to cover any combination in which the inventive novelty exercises its utility. Many modifications and variations of the present invention are possible in light of the above teachings and may be practiced otherwise than as specifically described while within the scope of the appended claims.

What is claimed is:

1. A modular tooling die for an axle housing of a vehicle comprising:

a post assembly including a plurality of separable post segments positioned adjacent to one another, the post assembly adapted to support a first u-shaped workpiece;

a pad assembly being linearly moveable along a first axis for clamping the workpiece to the post assembly, the pad assembly including a plurality of separable pad segments positioned adjacent to one another;

a cam driver assembly moveable along the first axis, the cam driver including a plurality of separable cam driver segments positioned adjacent to one another;

a first cam slide assembly linearly moveable along a second axis, the second axis extending perpendicularly to the first axis; and a second cam slide assembly being linearly moveable along the second axis in a direction opposite the first cam slide assembly, each cam driver segment including a first cam surface and an opposing second cam surface, the first cam surface extending at an angle relative to the first axis outwardly away from the post assembly, the second cam surface extending at an angle relative to the first axis outwardly away from the post assembly, the first cam slide assembly including separable first cam slide segments, each first cam slide segment corresponding to one of the cam driver segments and including a third cam surface facing a corresponding second cam surface, the second cam slide assembly including separable second cam slide segments, each second cam slide segment corresponding to one of the cam driver segments and including a fourth cam surface facing a corresponding first cam surface, wherein the first cam surfaces engage the fourth cam surfaces and the second cam surfaces engage the third cam surfaces to move the first cam slide assembly and the second cam slide assembly toward the post assembly when the cam driver assembly moves toward the first and second cam slides, the first cam assembly and the second cam assembly being configured to shear portions of the first workpiece as they translate toward one another, wherein each of the post segments, cam driver segments, first cam slide segments, and second cam slide segments that are coaxially aligned along the first axis are grouped together as die sets, wherein any one of the die sets is replaceable with another die set to account for a second workpiece having different geometry than the first workpiece.

2. The modular tooling die of claim 1, wherein the die sets include first, second, and third dies sets positioned adjacent to one another to shear portions of the first workpiece, the third die set being replaced with a fourth die set to shear the second workpiece.

3. The modular tooling die of claim 2, wherein the first cam slide segment includes a moveable first cam pad biased toward the first or second workpiece, the first cam pad positioned to contact the first or second workpiece prior to the knife.

4. The modular tooling die of claim 1, wherein removable a knife is fixed to the first cam slide segment, the knife adapted to engage and shear the first or second workpiece.

5. The modular tooling die of claim 1, wherein the first cam slide assembly and the second cam slide assembly are positioned to be driven by the cam driver assembly toward the first or second workpiece at the same time, the first and second cam slide assemblies being adapted to simultaneously shear portions from opposite sides of the first or second workpiece.

6. The modular tooling die of claim 1, wherein each of the first cam surface, the second cam surface, the third cam surface and the fourth cam surface each extend at an angle of 45 degrees relative to the first axis.

7. The modular tooling die of claim 1, wherein the first cam pad and the second cam pad are positioned to trap opposing side walls of the first or second workpiece against one of the post segments.

8. The modular tooling of claim 1, wherein one of the cam slide assemblies includes a stepped face.

* * * * *